United States Patent [19]

Ohlendorf et al.

[11] Patent Number: 4,859,418

[45] Date of Patent: Aug. 22, 1989

[54] PROCESS AND COMPOSITIONS FOR CORROSION INHIBITION OF METALLIC MATERIALS

[75] Inventors: Dieter Ohlendorf, Liederbach; Werner Interthal, Rüsselsheim; Friedrich Stoll, Hürth, all of Fed. Rep. of Germany

[73] Assignee: Hoechst Aktiengesellschaft, Frankfurt am Main, Fed. Rep. of Germany

[21] Appl. No.: 878,615

[22] Filed: Jun. 26, 1986

[30] Foreign Application Priority Data

Jun. 28, 1985 [DE] Fed. Rep. of Germany ..... 3523088

[51] Int. Cl.[4] ..... C23F 11/04

[52] U.S. Cl. ..... 422/16; 422/14; 252/390; 252/392; 252/394; 252/8.555

[58] Field of Search ..... 422/14, 16; 252/390, 252/392, 394, 397, 8.555

[56] References Cited

U.S. PATENT DOCUMENTS

| | | | |
|---|---|---|---|
| 4,067,690 | 1/1978 | Cuisia et al. | 422/16 |
| 4,187,277 | 2/1980 | Quinlan | 422/16 |
| 4,188,359 | 2/1980 | Quinlan | 422/16 |
| 4,404,167 | 9/1983 | Rosenfeld et al. | 422/16 |
| 4,405,494 | 9/1983 | Oppenlaender et al. | 422/16 |
| 4,479,917 | 10/1984 | Rothgery et al. | 422/16 |
| 4,487,745 | 12/1984 | Weiss et al. | 422/16 |
| 4,495,200 | 1/1985 | Lindstrom et al. | 422/16 |
| 4,578,243 | 3/1986 | Quinlan | 422/16 |
| 4,604,212 | 8/1986 | Matz | 422/16 |
| 4,686,084 | 8/1987 | Geke et al. | 422/14 |
| 4,689,201 | 8/1987 | Longworth et al. | 422/14 |

FOREIGN PATENT DOCUMENTS

| | | |
|---|---|---|
| 3224148 | 12/1983 | Fed. Rep. of Germany . |
| 3336198 | 4/1985 | Fed. Rep. of Germany . |

OTHER PUBLICATIONS

B. Sanyal, *Progress in Org. Coatings*, 9, 165–236 (1981).

M. H. Akstinat, *Werkstoff und Korrosion*, 21, 273–281 (1970).

I. L. Rozenfeld, *Corrosion Inhibitors*, McGraw-Hill Inc., N.Y., 1981, pp. 27–73, 97–142, 145–203.

S. W. Dean et al, *Materials Performance*, pp. 47–51 (Dec., 1981).

K. Risch, VDI-Berichte, No. 365, 115–124 (1980).

H. Hoffmann et al, *Ber. Bunsenges Phys. Chem.* 85, 255–256 (1981).

W. Schorr et al, J. Phys. Chem. 85, 3160–3167 (1981).

*Primary Examiner*—Kenneth M. Schor

*Assistant Examiner*—L. Johnson

[57] ABSTRACT

Use of the compounds of the formula

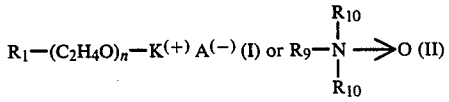

in which $R_1$ denotes $C_{12}$–$C_{26}$-alkyl or $C_{12}$–$C_{26}$alkenyl, n denotes a number from 0 to 5, $K^{(+)}$ denotes a group of the formulae

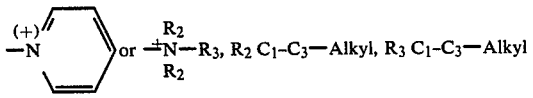

or a group of the formula $—(C_2H_4O)_xH$, x denotes a number from 1 to 3, $A^{(-}$ denotes an anion, $R_9$ denotes a group of the formula $R_1'$-$(OCH_2CH_2)_n$—, $C_8$–$C_{18}$-alkylaryl or aryl-$C_8$–$C_{18}$-alkyl, $R_1'$ denotes $C_{14}$–$C_{22}$-alkyl or $C_{14}$–$C_{22}$-alkenyl, n denotes a number from 0 to 5 and the radicals $R_{10}$ are identical and denote $C_1$–$C_4$-alkyl or $C_1$–$C_4$-hydroxyalkyl, as corrosion protection agents for metallic materials in aqueous media.

5 Claims, No Drawings

PROCESS AND COMPOSITIONS FOR CORROSION INHIBITION OF METALLIC MATERIALS

It is known that additives to aqueous and non-aqueous solutions can reduce (inhibit) the rate of corrosive attack. In particular, organic compounds such as amines, imines, quaternary ammonium salts, unsaturated alcohols and other substances act as inhibitors in media which attack metallic materials, particularly plain steels, by acid corrosion. (cf. Akstinat: Werkstoff und Korrosion [Material and Corrosion] 21, 273 (1970); Sanyal, B.: Progress in Organic Coatings 9, pp. 165–236 (1981): Rozenfeld, L. L.: Corrosion Inhibitors, McGraw Hill Inc., New York, 1981). Corrosion inhibitors are differentiated according to their mode of action as adsorption inhibitors, passivators, film- or protective coating-forming media, neutralizers and others (cf. Dean, S. W. et al.: Materials Performance, pp. 47–51 (1981)).

The amine group, comprising aliphatic and aromatic, saturated and unsaturated amine compounds, and the quaternary ammonium compounds, are known as adsorption inhibitors for acid corrosion. In agreement with the mode of protection, these substances only act in acidic aqueous media in the absence of oxidants, particularly atmospheric oxygen (Risch, K.: VDI Bericht [Association of German Engineers Report] 365, 11 (1980)). On the other hand, it is known that the protective action of inhibitors of corrosion in neutral and alkaline oxygen-containing aqueous media, particularly phosphorus-containing products, for example phosphates and polyphosphates, is dependent upon the formation of a film (film-forming inhibitors) or a barrier layer of precipitated solids, the corrosion protection action of which is strongly dependent on the medium and the initial growth conditions. Particularly in the case of heat transfer from a metallic material into the medium (heating elements, heat exchangers) layers can form which hinder the heat flow and lead to overheating or local corrosion under the protective coating which has formed.

It was thus surprising that specific compounds from the groups of the quaternary ammonium compounds, the oxalkylated quaternary ammonium compounds and the amine oxides are capable of effectively inhibiting the corrosion of metallic materials, particularly of plain steels and of copper, in the acidic, neutral and alkaline pH range, the protective action, particularly in flowing and neutral aqueous media, being independent of whether dissolved oxygen is or is not present.

The invention therefore relates to a process for the avoidance of corrosion of metallic materials in aqueous media, wherein a compound of the formula I or II $$R_1-(C_2H_4O)_n-Z^{(+)}\,A^{(-)} \qquad \text{(I)}$$

or

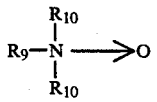

(II)

in which $R_1$ denotes $C_{12}$–$C_{26}$-alkyl or $C_{12}$–$C_{26}$-alkenyl, n denotes a number from 0 to 5, $Z^{(+)}$ denotes a group of the formula

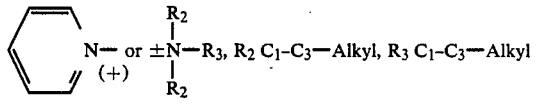

or a group of the formula $-(C_2H_4O)_xH$, x denotes a number from 1 to 3, $A^{(-)}$ denotes an anion of the following formulae: $SCN^{(-)}$, $R_4SO_3(-)$ where $R^4$ is $C_6$–$C_9$-alkyl or $C_6$–$C_9$-alkenyl and the sum of the carbon atoms in $R_1$ and $R_4$ should be at least 21;

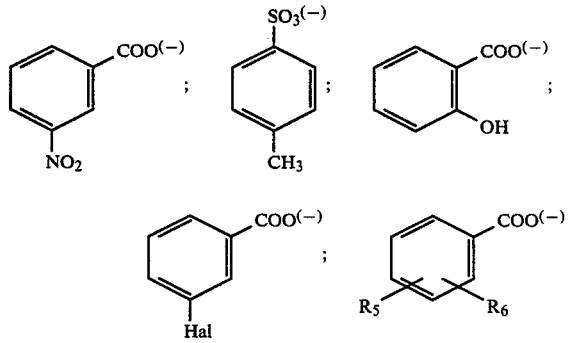

where Hal is fluorine, chlorine, bromine or iodine, $R_5$ is $C_1$–$C_5$-alkyl, $C_2$–$C_5$-alkenyl or $C_1$–$C_5$-alkoxy in the 3, 4, 5 and 6 positions and R6 is hydrogen or hydroxy in the 2 and 3 positions to the carboxyl group, and

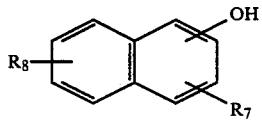

where $R_7$ is $COO^-$ or $SO_3(-)$ and $R_8$ is hydrogen or methyl, $R_9$ denotes a group of the formula $R_1'-(OCH_2CH_2)_n-$, $C_8$–$C_{18}$-alkylaryl or aryl-$C_8$–$C_{18}$-alkyl, $R_1'$ denotes $C_{14}$–$C_{22}$-alkyl or $C_{14}$–$C_{22}$-alkenyl, n denotes a number from 0 to 5 and the radicals $R_{10}$ are identical and denote $C_1$–$C_4$-alkyl or $C_1$–$C_4$-hydroxyalkyl, is added to the aqueous medium.

The salts of the following cations and anions are particularly preferred:

1.

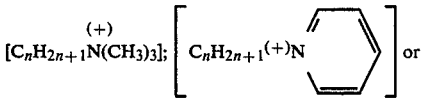

$$C_nH_{2n+1}\overset{(+)}{N}(CH_3)_2-(CH_2CH_2O)_xH \qquad \text{x being 1 or 2}$$

(a) with the anion $C_6H_{13}SO_3^{(-)}$ for n=20 to 26
(b) with the anion $C_7H_{15}SO_3^{(-)}$ for n=14 to 22
(c) with the anion $C_8H_{17}SO_3^{(-)}$ for n=14 to 20
(d) with the anion $SCN^{(-)}$ for n=16 to 26

2.

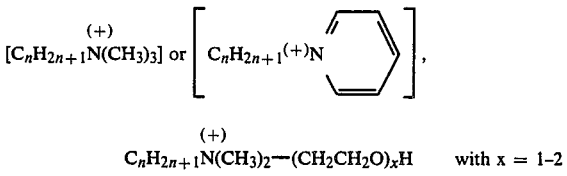

for n=12 to 24 with the following benzoic acid anions (a) salicylate or m-halobenzoate, (b)

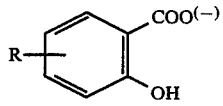

with R=methyl or ethyl or propyl or $C_nH_{2n+1}O$— with n=1 to 4, preferably in the 3 or 4 or 5 positions to the carboxyl group, (c)

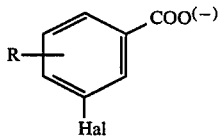

with R=methyl or ethyl or propyl or $C_nH_{2n+1}O$— with n=1 to 4, preferably in the 4 or 5 positions in the carboxyl group, (d)

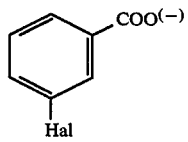

with Hal=F, Cl, Br, I (e)

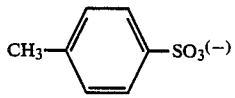

3.

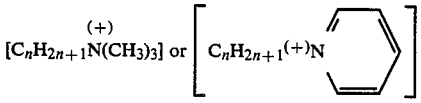

for n=12 to 24 with the anions 2-hydroxy-1-naphthoate, 3-(or 4)-hydroxy-2-naphthoate or the corresponding derivatives of naphtholsulfonic acids.

Those amine oxides of the formula II are preferred in which $R_9$ denotes alkyl or alkenyl. Aryl denotes preferably phenyl. Methyl and hydroxyethyl are preferred for $R_{10}$.

The compounds described above have a distinct anticorrosive action on all types of metallic materials, preferably for copper and plain steel. This anticorrosive action extends from the strongly acidic to the strongly alkaline pH range and is independent of the presence or absence of oxygen. The use of these compounds in flowing aqueous media such as, for example, for cooling and heating circuits is of particular interest. The concentrations employed of the compounds of the formula I are 0.01 to 5% by weight, preferably 0.05 to 2% by weight and particularly preferably 0.1 to 1% by weight. For the compounds of the formula II, this concentration is 0.075 to 3% by weight, preferably more than 0.4% by weight. For the preparation of the compounds of the formulae I and II, reference is made to German Offenlegungsschriften 3,224,148 and 3,336,198.

A different lower critical concentration limit, dependent on temperature, for adequate corrosion protection action exists for each of the compounds of the formulae I and II. This limit can, however, be determined by a simple preliminary experiment as described further below. The action is dependent on the temperature. The compounds mentioned act, as a group, in a temperature range of 0° C. to 145° C.; however, one single compound is only effective at a temperature of about 45° C. (±25° C.). The lower temperature limit for all compounds is the solubility temperature (isotropic solution) or, better, the Krafft point. If the surfactant is, however, in solution, the temperature can, in most cases, be below the solubility temperature by 5 to 25° C. for several hours to weeks without the effectiveness being lost. Use of those surfactants which remain in solution up to the melting point of the water is possible at temperatures under 0° C. if the melting point of the water is lowered by addition of organic solvents, such as, for example, ethylene glycol or isopropanol. Reduction of the melting point of the water by addition of electrolyte, such as, for example, NaCl, without loss of effectiveness is only possible to a limited extent.

It is known of some compounds of the formula I, such as, for example, hexadecylpyridiniumsalicylate (H. Hoffmann et al., Ber. Bunsenges. Phys. Chem. 85 (1981) 255) that they build up non-spherical, usually rod-shaped, micelles from the individual surfactant ions and counter-ions from a very particular concentration, the $CMC_{II}$, which is characteristic for each surfactant.

Surprisingly, it has now been found that surfactants in aqueous solution are always effective as corrosion protection agents when they form non-spherical, preferably rod-shaped, micelles at concentrations greater than the $CMC_{II}$. Non-spherical, preferably rod-shaped, micelles are present when, during investigation of the isotropic surfactant solution using the electric birefringence method with a pulsed, rectangular electric field (E. Fredericq and C. Housier, Electric Dichroism and Electric Birefringence, Claredon Press, Oxford 1973 and H. Hoffmann et al., Ber. Bunsenges. Phys. Chem. 85 (1981) 255), a relaxation time of $\geqq 0.5$ μs can be determined from the decay of a measuring signal which is found. The lower concentration limit from which a surfactant in aqueous solution is effective as a corrosion protection agent is therefore always fixed by means of the $CMC_{II}$, preferably at a concentration of 1.5 to 3 times the $CMC_{II}$. The determination of the $CMC_{II}$ is, for example, possible by measurement of the electric conductivity of the surfactant solution as a function of the surfactant concentration, as described by H. Hoffmann et al. (Ber. Bunsenges. Phys. Chem. 85 (1981)

255). It was found that the $CMC_{II}$ value is temperature-dependent and shifts to higher surfactant concentrations with increasing temperature.

The minimum concentration which is necessary to achieve adequate corrosion protection action in a particular temperature range can also be determined for salts of the formula I by determination of the $CMC_{II}$ at the application temperature using the electric conductivity.

The corrosion protection action in the examples below is tested in the conventional manner by determination of the weight loss of samples of the metallic materials (sample coupons), or, in particular cases where exclusively acidic corrosion predominates, also by determination of the erosion rates from the polarization resistance. The effectiveness of the individual inhibitor can be calculated by comparison with the erosion rates in solutions without additives:

$$\omega = \frac{V - V_1}{V} \times 100 \text{ in } \%$$

where V denotes the erosion rate without inhibitor, and $V_1$ the erosion rate with inhibitor.

EXAMPLE 1

The erosion rates and the inhibitor effectiveness of the compound hexadecyltrimethylammonium salicylate, $C_{16}$TA-Sal, was determined by measuring the polarization resistance in deionized water solutions in the concentrations 0.075% by weight and 0.1% by weight. A Magnachem measuring instrument (Corrater model 1136) was used for this. The results are compiled in Table 1. Plain steel (ST 37) and copper were studied.

TABLE 1

Material plain steel ST 37. Static final value of the erosion rates after 20 hours for $C_{16}$TA—Sal in non-aerated deionized water

| Temp. | Conc./% by weight | Erosion rate mm/year | Inhibitor effectiveness |
|---|---|---|---|
| 50 | 0 | 0.043 | — |
| " | 0.075 | 0.018 | 58% |
| " | 0.1 | 0.013 | 70% |

EXAMPLE 2

As described in Example 2, the inhibitor effectiveness for copper and plain steel (ST 37) of solutions of hexadecyltrimethylammonium 3-hydroxy-2-naphthoate ($C_{16}$TA-BHNA) in deionized water was investigated. The following concentrations were studied at a measuring temperature of 50° C.: 0.01; 0.025; 0.05; 0.075 and 0.1% by weight. The results were compiled in Table 2.

TABLE 2

Static final value of the erosion rate after 20 hours for $C_{16}$TA—BHNA in deionized water

| Material | Temp. | Conc./% by weight | Erosion rate mm/year | Inhibitor effectiveness |
|---|---|---|---|---|
| Plain steel | 50 | 0 | 0,038 | — |
| " | " | 0,01 | 0,007 | 84% |
| " | " | 0,025 | 0,007 | 84% |
| " | " | 0,050 | 0,001 | 98% |
| " | " | 0,075 | <0,001 | 100% |
| " | " | 0,100 | 0,002 | 95% |
| Cu | " | 0 | 0,029 | - |
| " | " | 0,01 | 0,036 | - |
| " | " | 0,025 | 0,016 | 45% |
| " | " | 0,050 | 0,015 | 48% |
| " | " | 0,075 | 0,009 | 69% |
| " | " | 0,100 | 0,010 | 65% |

EXAMPLE 3

The erosion rates of plain steel and copper in aerated and non-aerated deionized water with addition of 0.04, 0.05 and 0.075% by weight of $C_{16}$TA-BHNA were determined in a continuous flow apparatus by introduction of sample coupons and pipe samples. Table 3 contains the results.

TABLE 3

Erosion rates, determined by measurement of the weight loss for $C_{16}$TA—BHNA in deionized water

| Material | Temp. | Conc./% by weight | Erosion rate mm/year | Experiment duration days | Other |
|---|---|---|---|---|---|
| Plain steel | 65° C. | 0 | 2.17 | 9 | aerated solution |
| " (ST37) | 65° C. | 0.075 | 0.01 | 12 | " |
| " | 45–95° C. | 0.050 | 0.013 | 20 | " |
| " | 65° C. | 0.040 | 0.01 | 6 | " |
| " | 65° C. | 0.075 | 0.01 | 6 | " |
| " | 65° C. | 0 | 0.1 | 6 | non-aerated |
| " | 65° C. | 0.040 | 0.01 | 6 | solution |
| " | 65° C. | 0.075 | 0.01 | 6 | " |

EXAMPLE 4

As described in Example 3, the erosion rates for plain steel (ST37) of solutions of docosyltrimethylammonium 3-hydroxy-2-naphthoate in deionized water at 100° or 120° C. were investigated. Values less than 0.01 mm/year were measured at a concentration of 0.125% by weight.

EXAMPLE 5

As described in Example 3, the erosion rates for plain steel (ST37) of solutions of octadecyldi(hydroxyethyl) amine oxide in aerated deionized water at 65° C. were investigated. The erosion rate is 0.3 mm/year without additive, and less than 0.01 mm/year with 2% by weight of the substance.

EXAMPLE 6

As described in Example 1, the erosion rates for plain steel (ST37) of solutions of $C_{16}$TA-BHNA in 0.1 N hydrochloric acid at 65° C. were investigated. The value is 6.3 mm/year for concentration 0, 1.5 mm/year for 0.0075% by weight and 1.2 mm/year for 0.075% by weight, corresponding to an inhibitor effectiveness of 76% and 81% respectively.

EXAMPLE 7

As described in Example 3, the erosion rate for plain steel (ST37) of solutions of $C_{16}$TA-BHNA in 0.1 N hydrochloric acid at 65° C. was investigated. The value is 16.2 mm/year for concentration 0 and 0.9 mm/year for 0.075% by weight, corresponding to an inhibitor effectiveness of 94%.

EXAMPLE 8

A strong eroding corrosion was found in a test stand, for the investigation of the bursting behavior of plastic membranes, which contains brass, plain steel and zinc-plated steel pipes and with a total volume of 200 liters of aerated deionized water (T=80° C.). The addition of commercial phosphate-based inhibitors (DIANODIC II, Messrs. Betz, Düsseldorf) only provided unsatisfactory corrosion protection, detectable from the formation and drag-out of corrosion products. The addition of 0.1% by weight of $C_{16}$TA-BHNA completely prevented the formation of corrosion products. Erosion rates determined on additionally introduced plain steel (ST37) sample coupons were less than 0.01 mm/year (experiment duration 140 hours).

We claim:

1. A process for inhibiting corrosion of metallic materials in the presence of an aqueous medium, which comprises adding to the aqueous medium a compound of the formula I or II

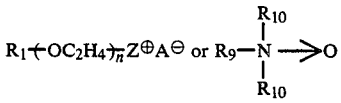

I II in which $R_1$ denotes $C_{12}$–$C_{26}$-alkyl or $C_{12}$–$C_{26}$-alkenyl; n denotes a number from 0 to 5; $Z^{\oplus}$ denotes a group of the formula

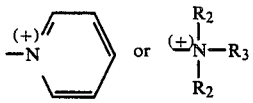

where $R_2$ is $C_1$–$C_3$-alkyl and $R_3$ is $C_1$–$C_3$-alkyl or a group of the formula $-(C_2H_4O)_xH$, x being a number from 1 to 3; $A^{\ominus}$ denotes an anion of the following formulae:

$SCN^{\ominus}$ or $R_4SO_3^{\ominus}$, where $R_4$ is $C_6$–$C_9$-alkyl or $C_6$–$C_9$-alkenyl, provided that the sum of the carbon atoms is $R_1$ and $R_4$ is at least 21; or $A^{\ominus}$ is

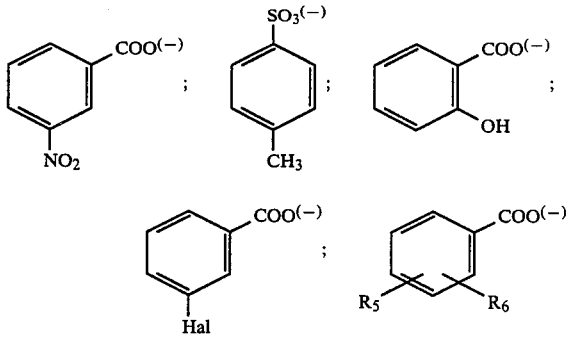

where Hal is fluorine, chlorine, bromine or iodine, $R_5$ is $C_1$–$C_5$-alkyl, $C_2$–$C_5$-alkenyl or $C_1$–$C_5$-alkoxy in the 3, 4, 5 and 6 positions and $R_6$ is hydrogen or hydroxy in the 2 and 3 positions to the carboxyl group or $A^{\ominus}$ is

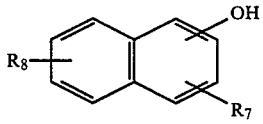

where $R_7$ is $COO^-$ or $SO_3(-)$ and $R_8$ is hydrogen or methyl, and in which: $R_9$ denotes a group of the formula $R_{12}$—$(OCH_2CH_2)y$—, $C_8$–$C_{18}$-alkylaryl or aryl-$C_8$–$C_{18}$-alkyl, $R_{12}$ denotes $C_{14}$–$C_{22}$-alkyl or $C_{14}$–$C_{22}$-alkenyl, y denotes a number from 0 to 5 and the radicals $R_{10}$ are identical and denote $C_1$–$C_4$-alkyl or $C_1$–$C_4$-hydroxyalkyl, said compound of formula I or II being in an amount effective to inhibit corrosion of a metallic material and inhibiting corrosion of said metallic material.

2. A process according to claim 1, which comprises adding to the aqueous medium a compound of formula I.

3. A process according to claim 2, wherein said compound of formula I is employed in the amount of 0.01 to 5% by weight.

4. A process according to claim 1, which comprises adding to the aqueous medium a compound of formula II.

5. A process according to claim 4, wherein said compound of formula II is employed in the amount of 0.075 to 3% by weight.

* * * * *